US010549404B1

(12) United States Patent
Norton

(10) Patent No.: US 10,549,404 B1
(45) Date of Patent: Feb. 4, 2020

(54) SANDING GLOVE AND ASSOCIATED SANDING ASSEMBLY

(71) Applicant: Scott Norton, Holland, MI (US)

(72) Inventor: Scott Norton, Holland, MI (US)

( * ) Notice: Subject to any disclaimer, the term of this patent is extended or adjusted under 35 U.S.C. 154(b) by 270 days.

(21) Appl. No.: 15/675,880

(22) Filed: Aug. 14, 2017

(51) Int. Cl.

| | |
|---|---|
| ***B24D 15/04*** | (2006.01) |
| ***A41D 19/015*** | (2006.01) |
| ***A41D 19/00*** | (2006.01) |
| *B24B 23/00* | (2006.01) |
| *B24D 11/00* | (2006.01) |

(52) U.S. Cl.
CPC ..... *B24D 15/045* (2013.01); *A41D 19/01552* (2013.01); *A41D 19/01594* (2013.01); *A41D 19/0024* (2013.01); *B24B 23/00* (2013.01); *B24D 11/00* (2013.01)

(58) Field of Classification Search
CPC .. A41D 19/01594; A41D 13/10; A41D 13/18; B24D 15/04; B24D 15/045
USPC ..... 2/161.1, 161.6, 161.8
See application file for complete search history.

(56) References Cited

U.S. PATENT DOCUMENTS

| | | | | |
|---|---|---|---|---|
| 3,164,841 A | | 1/1965 | Burtoff | |
| 4,733,412 A | * | 3/1988 | Campbell | A41D 19/0044 2/161.1 |
| 4,858,246 A | | 8/1989 | Wiggins | |
| 5,357,636 A | | 10/1994 | Dresdner, Jr. et al. | |
| 5,353,440 A | | 11/1994 | Meldeau | |
| 5,435,013 A | | 7/1995 | Davis | |
| 5,768,711 A | | 6/1998 | Wissink | |
| 5,898,944 A | | 5/1999 | Vrany | |
| 5,956,770 A | | 9/1999 | Dennis | |
| 6,018,837 A | | 1/2000 | Andreu | |
| 6,098,234 A | | 8/2000 | Jackson, Jr. | |
| 6,553,576 B1 | | 4/2003 | Knapp | |
| 6,557,178 B1 | | 5/2003 | Hoover | |
| 6,675,302 B2 | | 1/2004 | Albert | |
| 7,051,377 B1 | | 5/2006 | Milner et al. | |
| 7,874,020 B1 | * | 1/2011 | Franklin | A47L 13/18 15/229.11 |
| 8,225,427 B2 | | 7/2012 | Bevier | |
| 9,572,383 B2 | | 2/2017 | Kleinert | |
| 9,884,242 B2 | | 2/2018 | Kleinert | |
| 2008/0083050 A1 | * | 4/2008 | Baker | A41D 19/0003 2/161.8 |

(Continued)

FOREIGN PATENT DOCUMENTS

| | | | | |
|---|---|---|---|---|
| AT | 381057 | * | 2/1981 | B42D 15/02 |

*Primary Examiner* — Katherine M Moran
(74) *Attorney, Agent, or Firm* — King & Partners, PLC

(57) ABSTRACT

A sanding glove including: a glove body fabricated from a base layer of material, wherein the glove body includes a hand opening, a backing, a palm, a thumb compartment, an index finger compartment, a middle finger compartment, a ring finger compartment and a small finger compartment, wherein each of the finger compartments include palm sides, back sides and fingertip ends; a first strip of hook fastener material attached to the palm side of the thumb compartment; second, third, fourth, and fifth strips of hook fastener materials attached to the palm side of the index finger, the middle finger, the ring finger, and the small finger compartments; and wherein a loop backed sanding pad of any desired shape can be attached to at least one of the strips of hook fastener material to facilitate sanding.

1 Claim, 5 Drawing Sheets

(56) References Cited

U.S. PATENT DOCUMENTS

2012/0227158 A1* 9/2012 Ashworth ..... A41D 19/0065
2/164
2016/0113338 A1* 4/2016 Cox ..... A41D 19/01594
2/161.8

* cited by examiner

SANDING GLOVE AND ASSOCIATED SANDING ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to sanding gloves and associated assemblies (e.g., sanding gloves, sanding blocks, and sand paper, etcetera) and, more particularly, to novel sanding gloves that comprise configurations for releasably securing sanding blocks and/or sand paper to these gloves. The sanding gloves of the present invention protect a user's hand and enable a user to sand, for example, a surface being prepared for painting and/or staining while maintaining the requisite "control" and "feel" that a user normally experiences when sanding without a glove. The present invention further relates to sanding assemblies that preferably comprise a sanding glove, a sanding block, and sand paper.

2. Background Art

Gloves, hand protective wear, and associated accessories have been known in the art for years and are the subject of a plurality of patents and publications, including: U.S. Pat. No. 8,225,427 entitled "Glove with Gripping Surface," U.S. Pat. No. 7,051,377 entitled "Glove Having Article Locking Member," U.S. Pat. No. 6,675,392 entitled "Grip-Enhancing Glove," U.S. Pat. No. 6,553,576 entitled "Gripping Glove," U.S. Pat. No. 6,018,837 entitled "Cleaning and Scouring Glove," U.S. Pat. No. 5,898,944 entitled "Athletic Glove for Gripping Bats, Clubs and Racquets," U.S. Pat. No. 5,768,711 entitled "Sports Glove," U.S. Pat. No. 5,435,013 entitled "Gripping Glove," U.S. Pat. No. 5,353,440 entitled "Grip Glove," and U.S. Pat. No. 4,858,246 entitled "Golf Gloves for Improved Gripping"—all of which are hereby incorporated herein by reference in their entirety including all references cited therein.

U.S. Pat. No. 8,225,427 appears to disclose a glove with a base layer of a flexible material which extends along at least a palm-side portion of the glove which includes a palm area and inner sides of a plurality of finger stalls and a thumb stall. The glove also has a continuous second layer positioned on the palm-side portion and disposed on top of the base layer. The continuous second layer includes a plurality of contact areas and a contact surface. Also, the glove has a plurality of siping grooves which conduct liquid away from the contact surface and a plurality of channels which direct liquid away from the contact areas.

U.S. Pat. No. 7,051,377 appears to disclose an apparatus for a glove having means for encompassing an article to be gripped. The glove has a planar member extending substantially from the wrist area projecting toward the fingers and curving back towards the palm. The hook-like flap has hook and loop material positioned on the back side that mates with hook and loop material located on the finger tips. In use, the article to be held is positioned between the glove and hook-like member whereupon the hook-like member encompasses a part of the article to be held. Thereafter the fingers are curled until the mating hook and loop member are engaged thereby locking the gloves onto the article to be held. Additionally, means for securing the glove onto the hand using an adjustable wrist strap are disclosed.

U.S. Pat. No. 6,675,392 appears to disclose a control-enhancing material that includes a plurality of recesses, such as suction cups, positioned on the palm portion of the glove. The areas covered by the control-enhancing material include the underside of the index finger, the underside of the thumb, the underside of the little finger, and the underside of the middle and ring fingers. The control-enhancing material is positioned at all or some of the areas on the glove that contact a ball when the glove is worn on the hand of the user and the user is holding a ball. The control-enhancing material works to grip the surface of the ball by a suction force and a friction force. The additional grip is maintained even though the user moves his or her hand slightly either away from, towards, or laterally with respect to the ball.

U.S. Pat. No. 6,553,576 appears to disclose a gripping glove that comprises a glove body that includes a hand opening, a backing, a palm and finger spaces. Attached to the gripping glove are laces that are capable of being tied together so the glove body can be tied to an object to be gripped. Also, loops are attached to the glove body that are capable of receiving a user's fingertips which allow the user to grip the object. Further included with the gripping glove is a detachable sleeve that allows the user to grip alternative types of objects. The combination of the laces, loops and detachable sleeve allows the user to grip several different types of objects.

U.S. Pat. No. 6,018,837 appears to disclose a cleaning and scouring glove for providing a waterproof glove useful for scrubbing and cleaning. The inventive device includes a waterproof glove including a palm portion, a back portion, finger stalls, and a thumb stall cooperatively joined together to fit a wearer's hand. A generally flexible scouring material is disposed on each of the finger stalls and the thumb stall, and a generally flexible absorptive material is provided on the palm portion of the glove thereby facilitating different types of washing actions with the same glove.

U.S. Pat. No. 5,898,944 appears to disclose a glove for gripping a piece of athletic equipment to be swung by an athlete includes a glove shell formed by a palm portion, a back portion, a thumb portion and four finger portions. The palm and back portions form an opening through which the athlete inserts a hand. A palm strap extends across the palm portion, and has one end attached proximate to the opening and another end with holes through which the two middle finger portions project. A protrusion is attached transversely to the palm strap at a location proximate to the holes and toward the one end, thereby forming a section of the palm strap between the protrusion and the opening for wrapping around the piece of athletic equipment to be swung. A wrist strap is provided to secure the glove shell about a wrist of the athlete.

U.S. Pat. No. 5,768,711 appears to disclose a glove with projections or tabs attached to the thumb and finger sheaths of the glove. The tabs can easily be grasped to provide an axial removal force along each finger sheath, thus enhancing removal of the glove from a wearer's hand. In one embodiment, each tab is an integrally formed triangular fin attached to the top portion of each glove finger at the distal-most end of the glove finger. The tabs permit the application of an axial force along each finger and have been found to be particularly effective in removing sports gloves that are provided with one-half and three-quarter finger sheaths that fit snugly around a wearer's fingers. In another embodiment, the tabs project beyond the ends of the finger sheaths.

U.S. Pat. No. 5,435,013 appears to disclose a gripping glove for enhancing the ability of an individual to grasp an object such as a shaft or handle of a bat, pole, racket or club. The griping glove includes a body portion having a back side, a front or palm side and finger elements having elongated extensions. Fastening material is provided to retain the finger extensions in a substantially fixed arrangement relative to the front side of the body portion. A strap is attached to the body portion and overlays the finger extensions after they have been secured so as to prevent detachment of the extensions from the front side of the glove.

U.S. Pat. No. 5,353,440 appears to disclose a glove and auxiliary grip including a protuberance on a grip strap to provide a bearing surface against a cylindrical object which exerts a force on a user. The glove includes universally adjustable separable fasteners to position the glove on a hand of the user and an adjustable wrist strap to provide a secure connection between auxiliary grip and the stronger arm muscles of the user.

U.S. Pat. No. 4,858,246 appears to disclose an improved golf glove used as a training aid having an adjustable strap that forms a loop for the thumb attached to back of the glove extending approximately forty-five degrees from a line taken through the middle finger of the glove, a second strap attached to the index and middle finger of the glove approximately midway between the tip of the finger and the base of the finger stalls forming a loop between the back of the inner portions of the index and middle fingers of the glove.

Sandpaper and other abrasive materials and accessories have also been known in the art for years and are the subject of a plurality of patents and publications, including: U.S. Pat. No. 9,114,505 entitled "Sandpaper with Fibrous Non-Slip Layer," U.S. Pat. No. 6,613,113 entitled "Abrasive Product and Method of Making the Same," U.S. Pat. No. 5,553,926 entitled "Sandpaper Pad and Pad Support for a Detail Sander," U.S. Pat. No. 3,813,231 entitled "Sandpaper" and United States Patent Publication Number US 2012/0231707 A1 entitled "Sandpaper with Non-Slip Layer—all of which are hereby incorporated herein by reference in their entirety including all references cited therein.

U.S. Pat. No. 9,114,505 appears to disclose a sheet of sandpaper that includes a backing layer having opposed first and second major sides, an adhesive make coat on the second major side, abrasive particles at least partially embedded in the make coat, thereby defining an abrasive surface, and an exposed fibrous non-slip layer on the first major side. Methods of making and using such sandpaper are also provided.

U.S. Pat. No. 6,613,113 appears to disclose a flexible abrasive product comprising a flexible sheet-like substrate comprising a multiplicity of separated resilient bodies connected to each other in a generally planar array in a pattern which provides open spaces between adjacent connected bodies, each body having a first surface and an opposite second surface; and abrasive particles to cause at least the first surface to be an abrasive surface. A method of making the abrasive is provided by providing the substrate and providing abrasive particles to at least the first surface to provide an abrasive surface.

U.S. Pat. No. 5,533,926 appears to disclose a sandpaper pad and a pad support of corresponding shape for use with a detail sander. The sandpaper pad and pad support each has a substantially 90° forward corner formed by a pair of facet edges. A pair of outwardly inclined straight side edges extend rearwardly from the facet edges on opposite sides of the pad center line each being outwardly inclined from the center line 10°-30°. When the straight side edges are in use, the forward corner is inwardly offset, thereby minimizing forward corner wear.

U.S. Pat. No. 3,813,231 appears to disclose an improved flexible abrasive sheet and a process for producing the same. The flexible abrasive sheet includes a backing of a copolymer of ethylene and acrylic acid having a melt index as determined by ASTM Test No. D1238-57T of from about 10 up to about 50 and contains from about 15 up to about 20 percent polymerized acrylic acid based on the weight of the copolymer, and an abrasive grit partially embedded in the ethylene-acrylic acid copolymer backing. The flexible abrasive sheet is free of any adhesive or bonding agent between the backing and the abrasive grit.

United States Patent Publication Number US 2012/0231707 A1 appears to disclose an abrasive article, (e.g., a sheet of sandpaper, etcetera) comprising a backing layer having opposed first and second major surfaces, an adhesive make coat on the second major surface, abrasive particles at least partially embedded in the make coat, thereby defining an abrasive surface, and an exposed non-slip coating layer on the first major surface, the non-slip coating layer comprising at least a base resin and a tackifying resin.

While gloves and hand protective wear, as well as sandpaper and associated accessories, as disclosed hereinabove, have been known in the art for years, issues associated with protecting a user's hand and enabling the user to sand a surface while maintaining the requisite "control" and "feel" that a user normally experiences when sanding without a glove remain problematic and/or unresolved. As such, there remains a genuine demand for novel sanding gloves and associated assemblies that remedy the detriments and/or complications associated with utilizing conventional products.

These and other objects of the present invention will become apparent in light of the present specification, claims, and drawings.

SUMMARY OF THE INVENTION

The present invention is directed to a sanding glove comprising, consisting essentially of, and/or consisting of: (a) a glove body fabricated from a base layer of material, wherein the glove body includes a hand opening, a backing, a palm, a thumb compartment, an index finger compartment, a middle finger compartment, a ring finger compartment and a small finger compartment, wherein each of the finger compartments include palm sides, back sides and fingertip ends; (b) a first strip of hook fastener material attached to the palm side of the thumb compartment; (c) a second strip of hook fastener material attached to the palm side of the index finger compartment; (d) a third strip of hook fastener material attached to the palm side of the middle finger compartment; (e) a fourth strip of hook fastener material attached to the palm side of the ring finger compartment; (f) a fifth strip of hook fastener material attached to the palm side of the small finger compartment; and (g) wherein a loop backed sanding pad of any desired shape can be attached to at least one of the strips of hook fastener material to facilitate sanding.

In a preferred embodiment of the present invention, the sanding glove further comprises a sixth strip of hook fastener material attached to the palm proximate the trapezium bone of a user, a seventh strip of hook fastener material attached to the palm proximate the pisiform bone of a user, and an eighth strip of hook fastener material attached to the palm proximate the metacarpal joints of a user.

In another preferred embodiment of the present invention, the sanding glove further comprises a ninth strip of hook fastener material attached to the backing of the glove body proximate to and spanning across the capitate and the hamate bones of a user.

In yet another preferred embodiment of the present invention, the sanding glove further comprises a second layer of material positioned proximate the thumb compartment on the palm-side and disposed on top of the base layer.

In a preferred embodiment of the present invention, the sanding glove further comprises a third layer of material positioned proximate the thumb compartment, the pisiform bone of a user, and the metacarpal joints of a user on the palm-side and disposed on top of at least a portion of the first and second layers of material.

In another preferred embodiment of the present invention, a tip of the thumb compartment, the index finger compartment, the middle finger compartment, the ring finger compartment and the small finger compartment are each coated with an elastomer, such as a thermoplastic elastomer.

In a preferred embodiment of the present invention, the thermoplastic elastomer is selected from the group consisting of a styrenic block copolymer, a thermoplastic olefin, an elastomeric alloy, a thermoplastic polyurethane, a thermoplastic copolyester, a thermoplastic polyamide, and combinations thereof.

In accordance with the present invention, the elastomer is selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

The present invention is also directed to a sanding assembly, comprising, consisting essentially of, and/or consisting of: (a) a sanding block, wherein the sanding block comprises a first side associated with loop fasteners, and second, third and fourth sides associated with hook fasteners; (b) a piece of sandpaper having a looped back side associated with the hook fasteners of the second, third, and fourth sides of the sanding block; (c) and a sanding glove having hook fasteners associated with the loop fasteners of the first side of the sanding block.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

While this invention is susceptible of embodiment in many different forms, there is disclosed and described herein in detail several specific embodiments with the understanding that the present disclosure is to be considered as an exemplification of the principles of the invention and is not intended to limit the invention to the embodiments illustrated.

Figure 1:
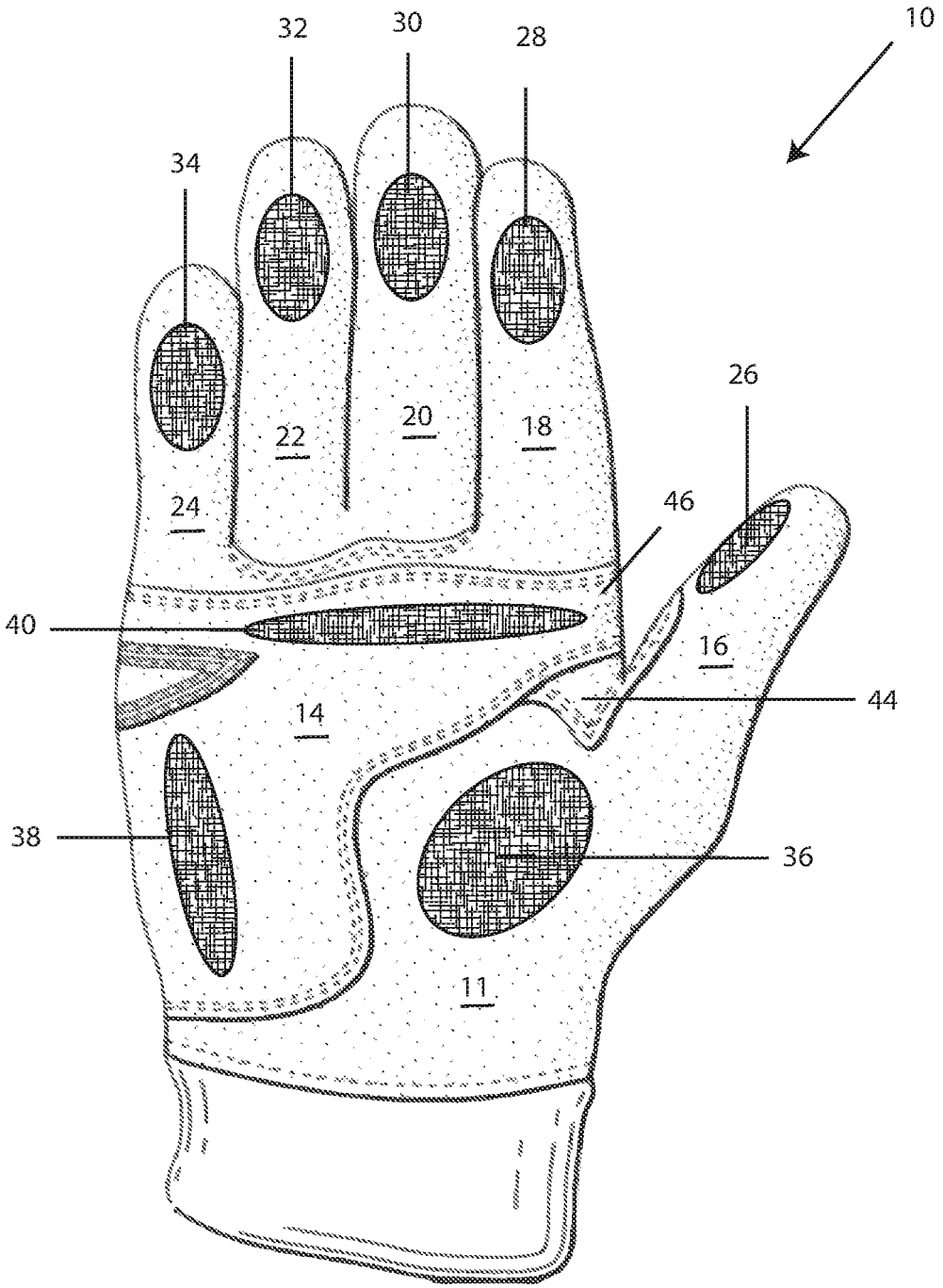
FIG. 1 of the drawings is an isometric view of a palm side of a sanding glove manufactured in accordance with the present invention.
Figure 2:
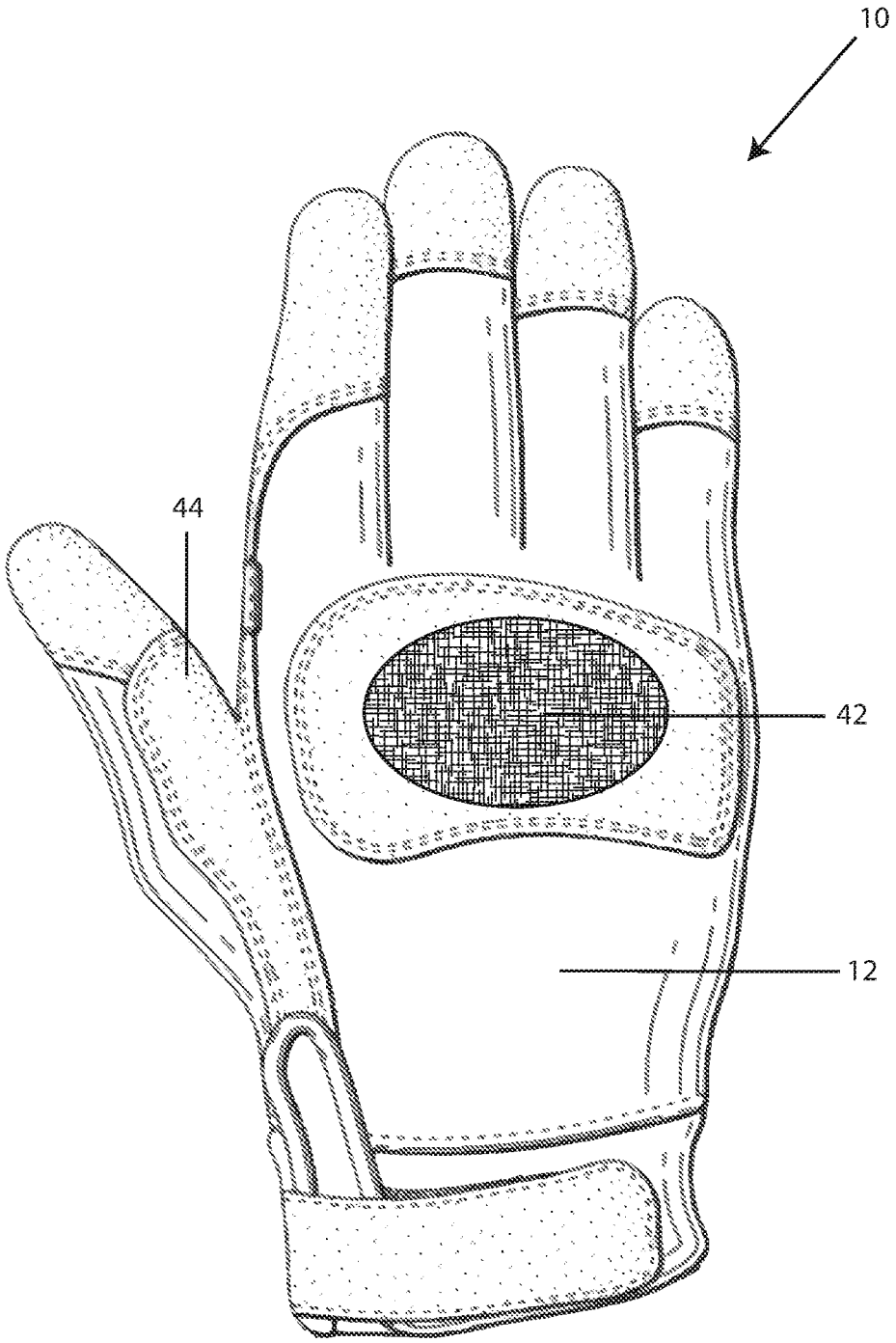
FIG. 2 of the drawings is an isometric view of a back side of a sanding glove manufactured in accordance with the present invention.

Referring now to the drawings and, more particularly, to FIGS. 1-2, sanding glove 10 is shown, which generally comprises a glove body fabricated from base layer of material 11 (e.g., natural and/or synthetic materials, leather, cotton, rubber, vinyl, plastic, etcetera). The glove body includes a hand opening (not shown), backing 12, palm 14, thumb compartment 16, index finger compartment 18, middle finger compartment 20, ring finger compartment 22 and small finger compartment 24. In accordance with the present invention, each one of the thumb/finger compartments includes palm sides, back sides and fingertip ends. Sanding glove 10 further includes first strip 26 of hook fastener material attached to the palm side of thumb compartment 16, second strip 28 of hook fastener material attached to the palm side of index finger compartment 18, third strip of hook fastener material 30 attached to the palm side of middle finger compartment 20; fourth strip of hook fastener material 32 attached to the palm side of ring finger compartment 22; fifth strip of hook fastener material 34 attached to the palm side of small finger compartment 24. It will be understood that the above-identified strips of fastener material may comprise any one of a number of peripheral geometries including, but not limited to, triangular, rectangular, square, hexagonal, octagonal, polygonal, circular, elliptical, oval—just to name a few. It will be further understood that a loop backed sanding pad (with or without a sanding block or pad) of any desired shape can be attached to at least one of the strips of hook fastener materials to facilitate sanding.

In accordance with the present invention, the loop fastener material can be, for example, Velcro® brand hook and loop fastener material (Velcro® is a registered trademark of Velcro USA Inc., 406 Brown Avenue, Manchester, N.H. 03103 for its brand of hook and loop fasteners.) Numerous types of hook and loop fasteners are available. In the preferred embodiment, Velcro® brand hook and loop fastener material from the ULTRA-MATE® series 705, type HTH Hook 22 is utilized. This type of hook fastener material is made of a nylon copolymer that is similar to woven nylon and is readily sewn. This type of material was selected to provide ease of separation of the hooks from the loops while simultaneously providing high shear strength to prevent the fasteners from separating while in use.

In one embodiment of the present invention, sanding glove 10 includes one or more additional strips of hook fasteners. In particular, sanding glove 10 further optionally includes one or more of sixth strip of hook fastener material 36 attached to the palm proximate the trapezium bone of a user, seventh strip of hook fastener material 38 attached to the palm proximate the pisiform bone of a user, and an eighth strip of hook fastener material 40 attached to the palm proximate the metacarpal joints of a user. It will be understood that the sixth, seventh, and eighth strips of hook fastener material facilitate enhanced control and feel for sanding applications with a sanding block.

As is best shown in FIG. 2, sanding glove 10 may also include ninth strip of hook fastener material 42 which is attached to the backing of the glove body proximate to and spanning across the capitate and the hamate bones of a user. Such positioning enables both storage of extra sandpaper and back-sided or back-handed sanding for large area and/or certain hard to reach applications.

As is further shown in FIGS. 1 and 2, optional second layer of material 44 is positioned proximate thumb compartment 16 on the palm-side and disposed on top of base layer 11. Optional third layer of material 46 is positioned proximate thumb compartment 16, the pisiform bone of a user, and the metacarpal joints of a user on the palm-side and is disposed on top of at least a portion of first and second layers of material 11 and 44, respectively.

Figure 3:
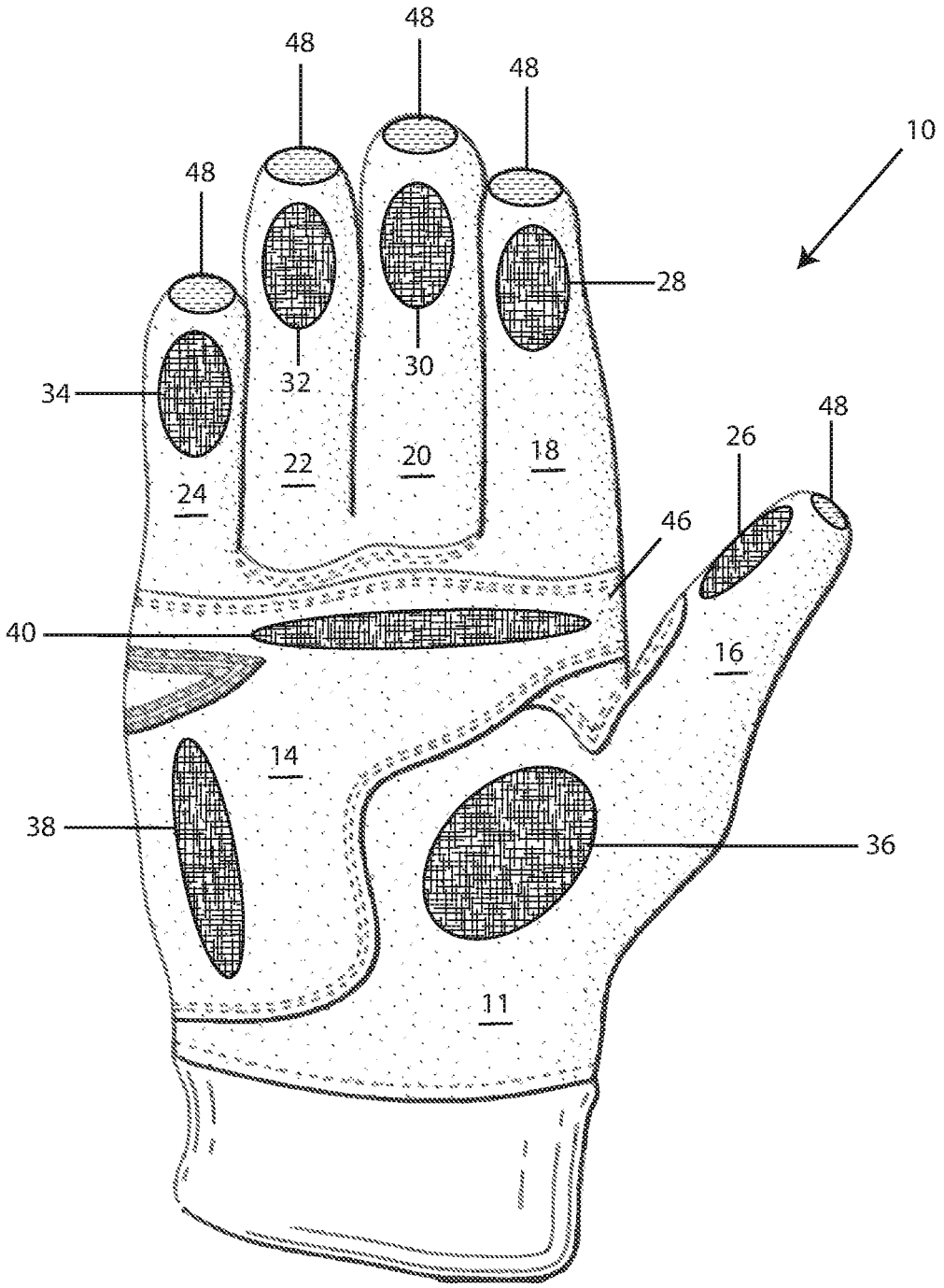
FIG. 3 of the drawings is an isometric view of an alternative embodiment a palm side of a sanding glove manufactured in accordance with the present invention.
Figure 4:
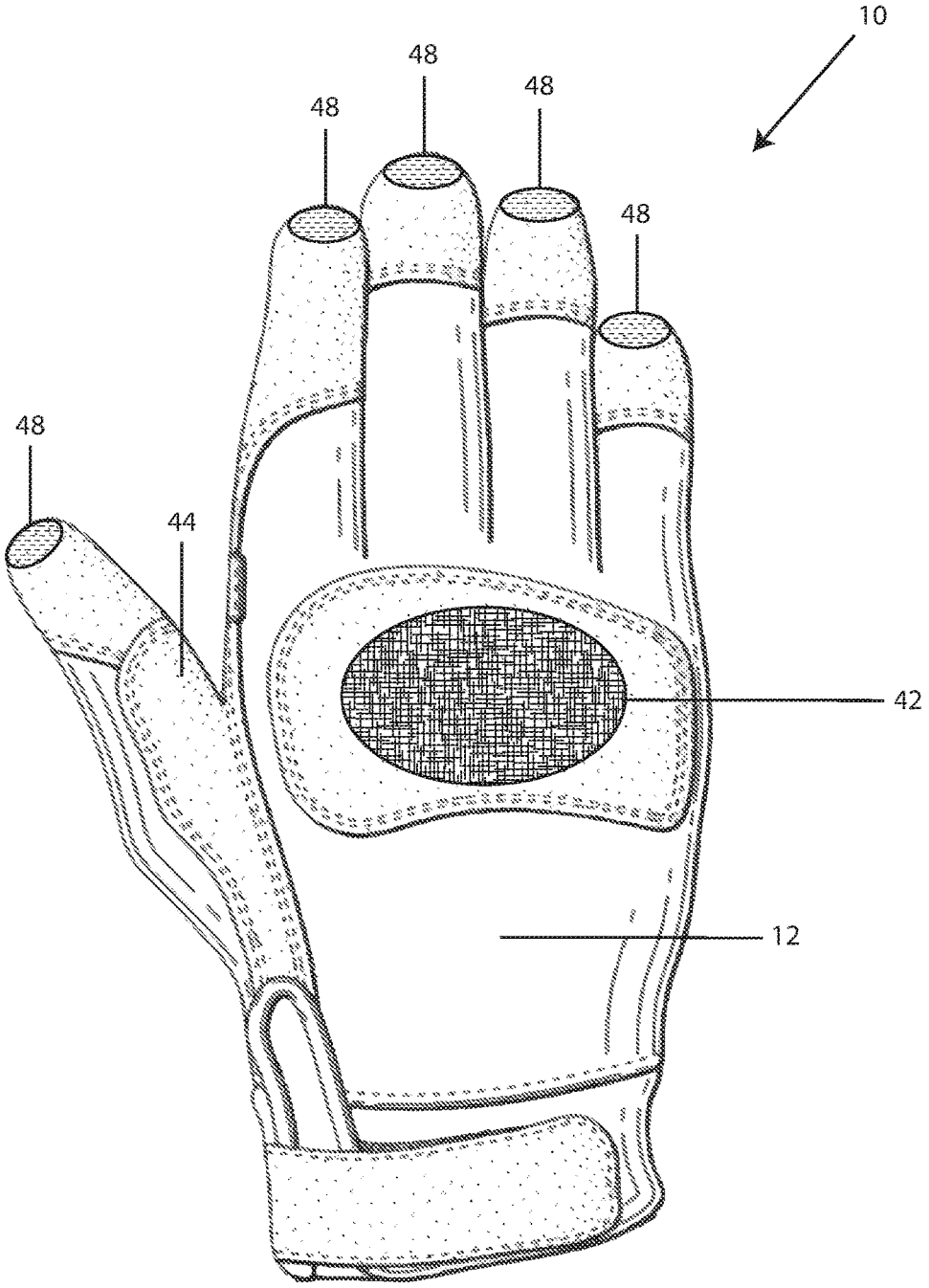
FIG. 4 of the drawings is an isometric view of an alternative embodiment of a back side of a sanding glove manufactured in accordance with the present invention.

Referring now to FIGS. 3 and 4, sanding glove 10, may also optionally include an elastomer and/or elastomeric material 48 associated with the tips of one or more of thumb compartment 16, index finger compartment 18, middle finger compartment 20, ring finger compartment 22, and small finger compartment 24. Such elastomeric material affords a user additional control and feel by virtue of controlled grip that releases with mild to moderate lateral forces. The elastomeric material applied to the tips of the various compartments also reduces the accumulation of residue thereon, which, in turn, minimizes scratching from traditional residue buildup.

In a preferred embodiment of the present invention, the elastomer and/or elastomeric material comprises a thermoplastic elastomer, such as, but not limited to, a styrenic block copolymer, a thermoplastic olefin, an elastomeric alloy, a thermoplastic polyurethane, a thermoplastic copolyester, a thermoplastic polyamide, and combinations thereof.

In another preferred embodiment of the present invention, the elastomer comprises a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and/or combinations thereof.

In a preferred embodiment of the present invention, the tips of one or more of thumb compartment 16, index finger compartment 18, middle finger compartment 20, ring finger compartment 22, and small finger compartment 24 are overmolded with the elastomeric material. It will be understood that the elastomeric material may also be associated with any portion of glove 10 via etch coating, dip coating, spin coating, brush coating and/or spray coating—including, but not limited to, cold spraying, thermal spraying, high velocity spraying (e.g., supersonic), low velocity spraying (e.g., subsonic), triboelectric discharge kinetic spraying and other similar processes.

Figure 5:
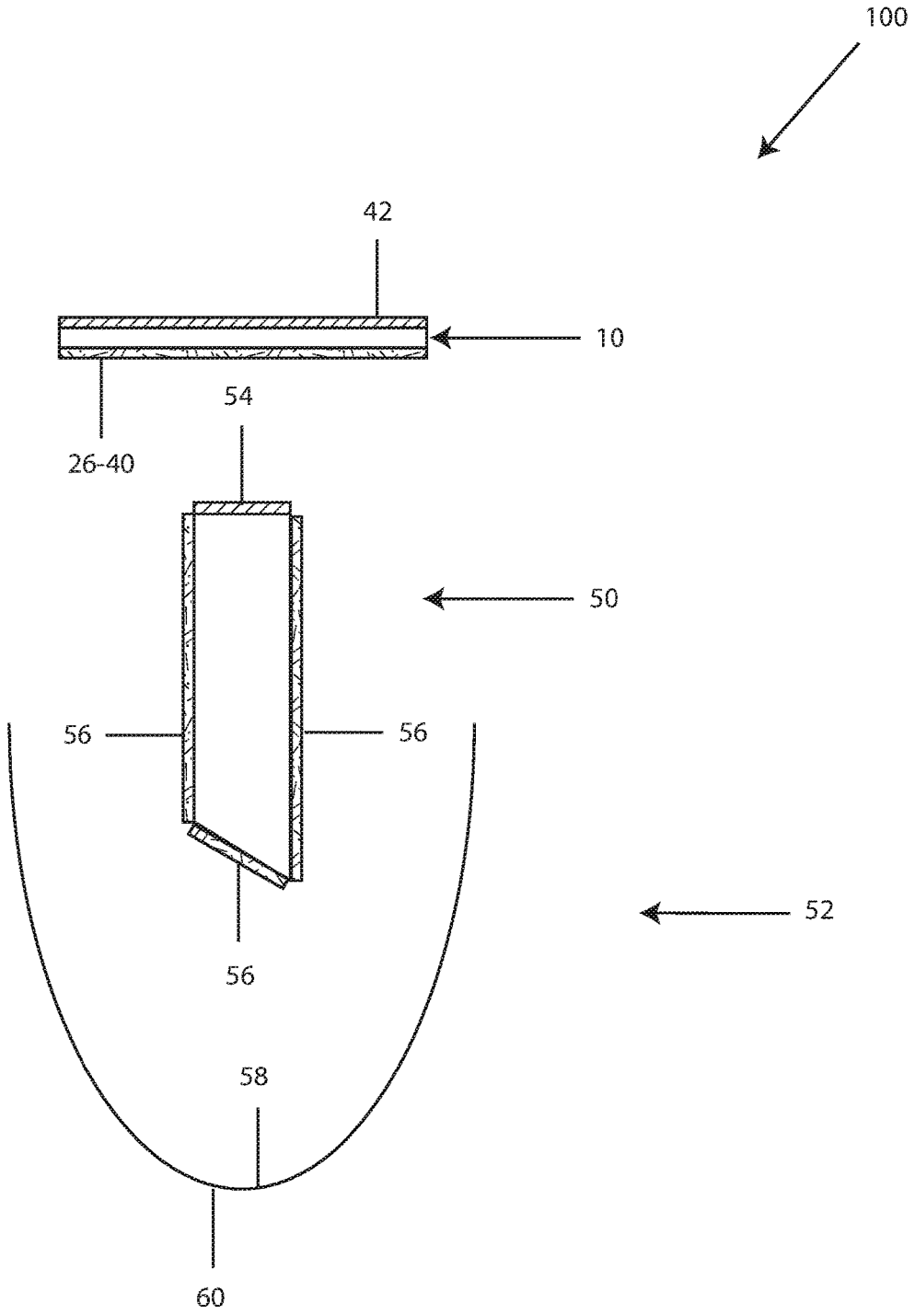
FIG. 5 of the drawings is an exploded side view of a sanding assembly manufactured in accordance with the present invention.

Referring now to FIG. 5, the present invention is also directed to sanding assembly 100 that generally comprises sanding block 50, sandpaper 52, and sanding glove 10 (See FIGS. 1-4). In one embodiment, sanding block 50 comprises first side 54 associated with loop fasteners, and second, third and fourth sides 56 associated with hook fasteners. Sandpaper 52 includes looped back side 58 that in use is associated with hook fasteners of second, third, and fourth sides 56 of sanding block 50. During normal use, abrasive side 60 of sandpaper 52 interacts with the surface being prepared for staining and/or painting. Sanding glove 10 includes a plurality of hook fasteners (e.g., fasteners 26-40) associated with loop fasteners of first side 54 of sanding block 50.

It will be understood that the loop and/or hook fasteners of the present invention may be associated with the sanding glove via any one of a number of means including but not limited to stitching, gluing, etcetera. It will be further understood that the sanding glove may have one or more of the finger and/or thumb compartments removed for a modified and/or palm only glove configuration.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A sanding assembly, comprising:

a sanding block, wherein the sanding block comprises a first side associated with loop fasteners, and second, third and fourth sides associated with hook fasteners;

a piece of sandpaper having a looped back side associated with the hook fasteners of the second, third, and fourth sides of the sanding block;

and a sanding glove having hook fasteners associated with the loop fasteners of the first side of the sanding block.

* * * * *